US009502762B2

(12) United States Patent
Jian et al.

(10) Patent No.: US 9,502,762 B2
(45) Date of Patent: Nov. 22, 2016

(54) ANTENNA STRUCTURE

(71) Applicant: Tigress Global LLC, Herndon, VA (US)

(72) Inventors: Ming-Shen Jian, Kaohsiung (TW); Jie-Yu Wu, Taipei (TW); Jia-Cheng Lin, New Taipei (TW); Jie-Ren Lin, Taichung (TW); Meng-Wei Chiu, New Taipei (TW); Yu-Seng Cheng, New Taipei (TW)

(73) Assignee: Tigress Global LLC, Herndon, VA (US)

( * ) Notice: Subject to any disclaimer, the term of this patent is extended or adjusted under 35 U.S.C. 154(b) by 258 days.

(21) Appl. No.: 14/013,044

(22) Filed: Aug. 29, 2013

(65) Prior Publication Data

US 2014/0062833 A1 Mar. 6, 2014

(30) Foreign Application Priority Data

Sep. 6, 2012 (TW) ..... 101132515 A
Sep. 6, 2012 (TW) ..... 101217203 U

(51) Int. Cl.
*H01Q 3/01* (2006.01)
*H01Q 1/08* (2006.01)
*H01Q 1/12* (2006.01)

(52) U.S. Cl.
CPC ..... *H01Q 3/01* (2013.01); *H01Q 1/084* (2013.01); *H01Q 1/1235* (2013.01)

(58) Field of Classification Search
CPC ..... H01Q 3/01; H01Q 1/084
See application file for complete search history.

(56) References Cited

U.S. PATENT DOCUMENTS 8,737,064 B2 * 5/2014 Son et al. ..... 361/679.59
2006/0187124 A1 * 8/2006 Goldberg ..... 343/700 MS

FOREIGN PATENT DOCUMENTS

TW M279995 11/2005
TW 200629651 A 8/2006
TW M295801 8/2006
WO 90/10959 A1 9/1990
WO 2009/080571 A1 7/2009

* cited by examiner

*Primary Examiner* — Sue A Purvis
*Assistant Examiner* — Noel Maldonado
(74) *Attorney, Agent, or Firm* — CKC & Partners Co., Ltd.

(57) ABSTRACT

An antenna structure includes a base, at least one first extending member and at least one second extending member. The base is detachably and pivotally connected to the first extending member, and includes a first transmitting unit. The first extending member is detachably and pivotally connected to the second extending member, and includes a second transmitting unit. The second extending member includes a third transmitting unit. The first transmitting unit is electrically connected to the second transmitting unit, and the second transmitting unit is electrically connected to the third transmitting unit.

9 Claims, 7 Drawing Sheets

ANTENNA STRUCTURE

RELATED APPLICATIONS

This application claims priority to Taiwan Application Serial Number 101132515, filed Sep. 6, 2012, and Taiwan Application Serial Number 101217203, filed Sep. 6, 2012, which are herein incorporated by references.

BACKGROUND

Technical Field

The present invention relates to an antenna structure. More particularly, the present invention relates to a pivotable antenna structure.

Description of Related Art

In general, antenna is a part of wireless transmission for transmitting and receiving electromagnetic waves, and is usually made of conductor material or dielectric material. For applying to different frequency ranges, the antenna should have different shapes and sizes. However, the general build-in antenna of the wireless transmitting device with fixed shape and size cannot be adjusted easily.

The length of the antenna is longer, the efficiency is better. In order to increase the convenience, the telescope antenna is provided. However, the maximum length of the telescope antenna is also restricted, that is, the length of the telescope antenna is also limited.

Furthermore, when the telescope antenna is lengthened but could not be adjusted with the intensity of the signal, the efficiency of the antenna still is limited. For solving the said problem, the telescope antenna with a pivoting portion for adjusting the direction to receive the signal is provided.

However, the length of the said telescope antenna is fixed, so that the telescope antenna cannot receive the wider range of the signal. The pivoting portion of the telescope antenna only can be connected to the base or external device for adjusting the direction due to the restricted length of the antenna, so that the adjusted direction of the antenna is limited. Therefore, if the antenna has the flexible length an angle, and the shape or size can be adjusted easily, the efficiency and convenience can be enhanced.

SUMMARY

According to one aspect of the present disclosure, an antenna structure includes a base, a first extending member and a second extending member. The base has a first pivoting portion and an outputting end. The base includes a first transmitting unit located in the base, wherein two ends of the first transmitting unit are electrically connected to the outputting end and the first pivoting portion of the base respectively, and the end which connected to the first pivoting portion is exposed from the first pivoting portion. The first extending member has a second pivoting portion and a third pivoting portion, wherein the second pivoting portion of the first extending member is detachably and pivotally connected to the first pivoting portion of the base. The first extending member includes a second transmitting unit located in the first extending member, wherein two ends of the second transmitting unit are electrically connected to and exposed from the second pivoting portion and a third pivoting portion of the first extending member respectively. The second extending member has a second pivoting portion and a third pivoting portion, wherein the second pivoting portion of the second extending member is detachably and pivotally connected to the third pivoting portion of the first extending member. The second extending member includes a third transmitting unit located in the second extending member, wherein two ends of the third transmitting, unit are electrically connected to and exposed from the second pivoting portion and a third pivoting portion of the second extending member respectively.

According to another aspect of the present disclosure, an antenna structure includes a plastic base, a first plastic extending member and a second plastic extending member. The plastic base has a first connecting portion and an outputting end. The plastic base includes a first transmitting unit located in the plastic base, wherein two ends of the first transmitting unit are electrically connected to the outputting end and the first connecting portion of the plastic base respectively, and the end which connected to the first connecting portion is exposed from the first connecting portion. The first plastic extending member has a second connecting portion and a third connecting portion, wherein the second connecting portion of the first plastic extending member is detachably connected to the first connecting portion of the plastic base. The first plastic extending member includes a second transmitting unit located in the first plastic extending member, wherein two ends of the second transmitting unit are electrically connected to and exposed from the second connecting portion and a third connecting portion of the first plastic extending member respectively. The second plastic extending member has a second connecting portion and a third connecting portion, wherein the second connecting portion of the second plastic extending member is detachably connected to the third connecting portion of the first plastic extending member. The second plastic extending member includes a third transmitting unit located in the second plastic extending member, wherein two ends of the third transmitting unit are electrically connected to and exposed from the second connecting portion and a third connecting portion of the second plastic extending member respectively.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
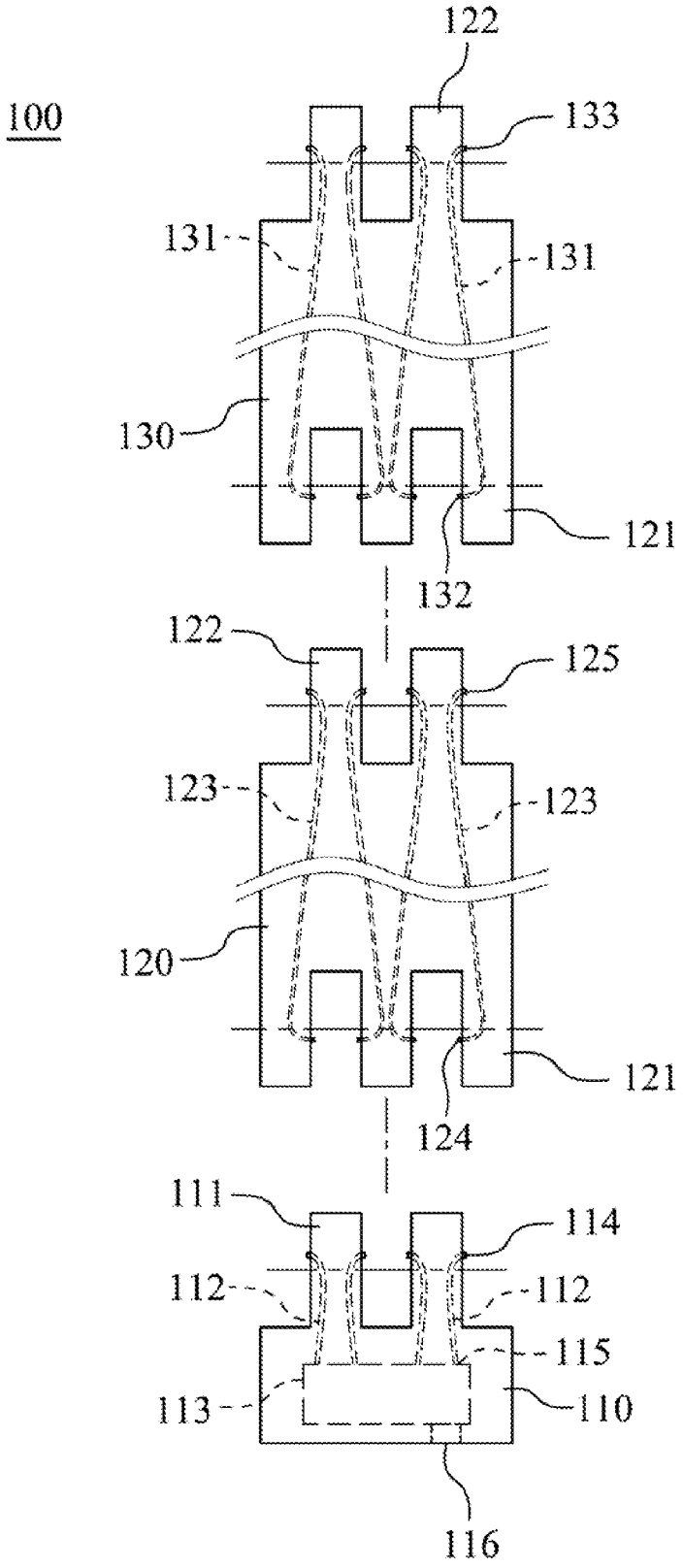
FIG. 1 is a schematic view of an antenna structure according to one embodiment of the present disclosure.

FIG. 1 is a schematic view of an antenna structure 100 according to one embodiment of the present disclosure. The antenna structure 100 includes a base 110, a first extending member 120 and a second extending member 130. The base 110 is pivotally connected to the first extending member 120, and the first extending member 120 is pivotally connected to the second extending member 130. The base 110 has a first pivoting portion 111 and an outputting end 116, and includes a first transmitting unit 112. In detail, the first transmitting unit 112 is located in the base 110, wherein two ends 114, 115 of the first transmitting unit 112 are electrically connected to the outputting end 116 and the first pivoting portion 111 of the base 110 respectively, and the end 114 which connected to the first pivoting portion 111 is exposed from the first pivoting portion 111. The base 110 can further includes a controlling unit 113 for controlling the transmission of the wireless signal of the antenna structure 100. The end 115 of the first transmitting unit 112 can be electrically connected to the outputting end 116 via the controlling unit 113. The first extending member 120 has a second pivoting portion 121 and a third pivoting portion 122, wherein the second pivoting portion 121 of the first extending member 120 is detachably and pivotally connected to the first pivoting portion 111 of the base 110. The first extending member 120 includes a second transmitting unit 123 located in the first extending member 120, wherein two ends 124, 125 of the second transmitting unit 123 are electrically connected to and exposed from the second pivoting portion 121 and the third pivoting portion 122 of the first extending member 120 respectively. The second extending member 130 has a second pivoting portion 121 and a third pivoting portion 122, wherein the second pivoting portion 121 of the second extending member 130 is detachably and pivotally connected to the third pivoting portion 122 of the first extending member 120. The second extending member 130 includes a third transmitting unit 131 located in the second extending member 130, wherein two ends 132 of the third transmitting unit 131 are electrically connected to and exposed from the second pivoting portion 121 and the third pivoting portion 122 of the second extending member 130 respectively.

In FIG. 1, the first pivoting portion 111 of the base 111 and the third pivoting portion 122 of the first extending member 120 are convex-shaped, and the second pivoting portions 121 of the first extending member 120 and the second extending member 130 are concave-shaped which corresponding to the first pivoting portion 111 of the base 111 and the third pivoting portion 122 of the first extending member 120. By such arrangement, the end 114 of the first transmitting 'unit 112 is electrically connected to the end 124 of the second transmitting unit and the end 125 of the second transmitting unit 123 is electrically connected to the end 132 of the third transmitting unit 131. Therefore, the transmitting or receiving efficiency and range of the antenna structure can be enhanced and broadened. In detail, the first transmitting unit 112, the second transmitting unit 123 and the third transmitting unit 131 can be made of copper wire, aluminium wire or another conducting material, The first extending member 120 and the second extending member 130 can be geometric-shaped.

Figure 2:
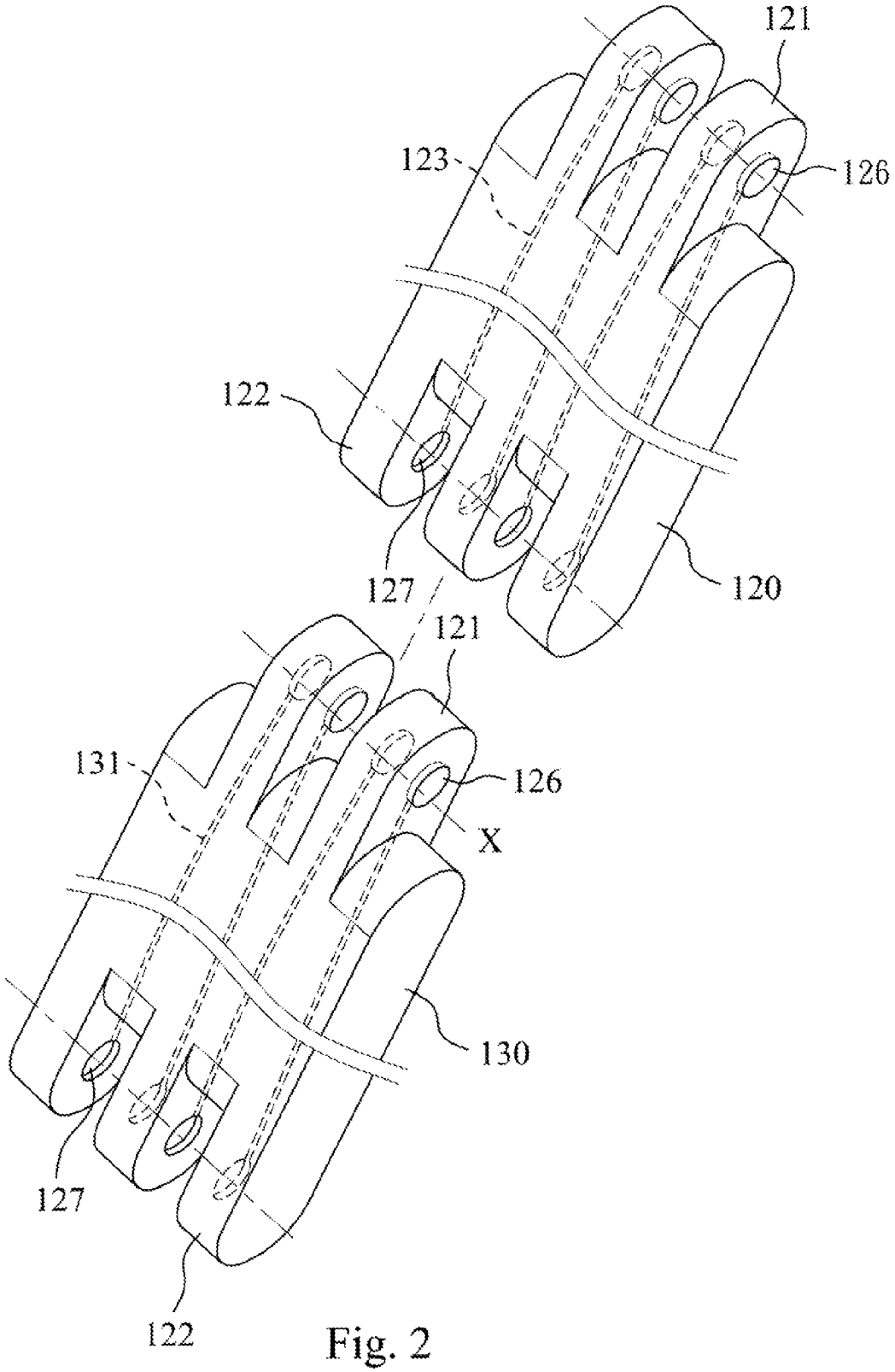
FIG. 2 shows a three-dimensional view of an antenna structure according to another embodiment of the present disclosure.
Figure 3:
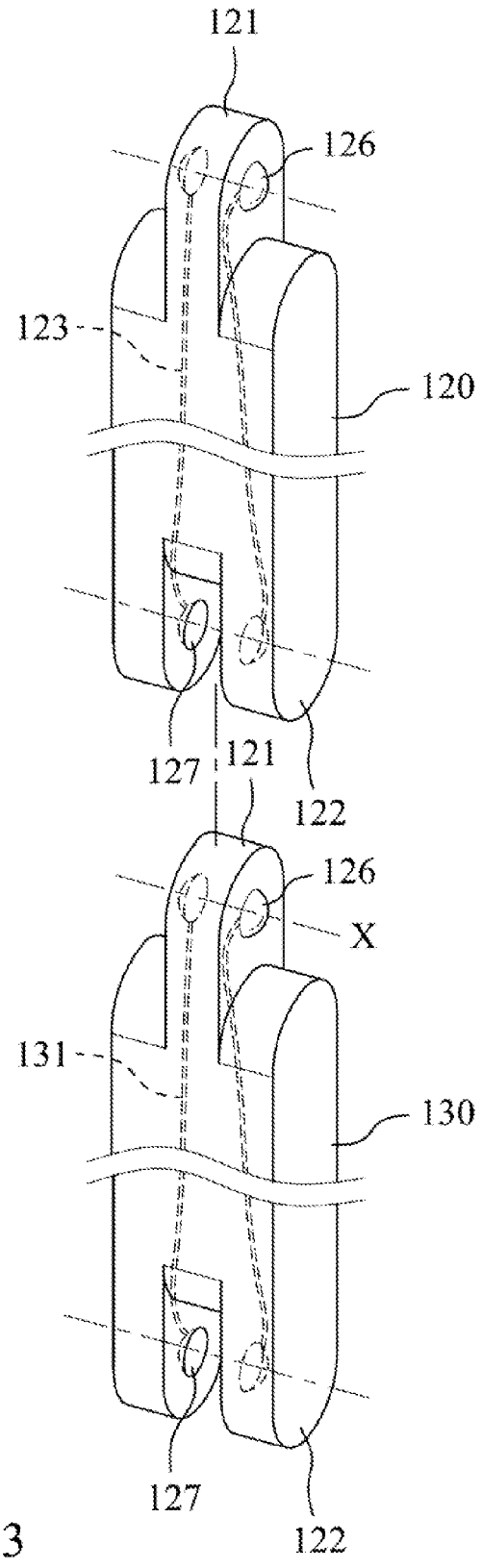
FIG. 3 shows a three-dimensional view of an antenna structure according to still another embodiment of the present disclosure.

FIGS. 2 and 3 show three-dimensional view of an antenna structure according to others embodiments of the present disclosure. The antenna structure includes a first extending member 120 and a second extending member 130. The first extending member 120 has a second pivoting portion 121 and a third pivoting portion 122, and includes a second transmitting unit 123. Two ends 126, 127 of the second transmitting unit 123 are electrically connected to and exposed from the second pivoting portion 121 and the third pivoting portion 122 of the first extending member 120 respectively. The second extending member 130 has a second pivoting portion 121 and a third pivoting portion 122, and includes a third transmitting unit 131. Two ends 126, 127 of the third transmitting unit 131 are electrically connected to and exposed from the second pivoting portion 121 and the third pivoting portion 122 of the second extending member 130 respectively. When the second pivoting portion 121 of the second extending member 130 is pivotally connected to the third pivoting portion 122 of the first extending member 120, the exposed end 126 of the third transmitting unit 131 can be electrically connected to the exposed end 127 of the second transmitting unit 123.

In FIGS. 2 and 3, the ends 126, 127 of the second transmitting unit 123 and the third transmitting unit 131 are exposed from the virtual axes X of the second pivoting portion 121 and the third pivoting portion 122 of each of the first extending member 120 and the second extending member 130. In detail, the end 127 of the second transmitting unit 123 which exposed from the second pivoting portion 121 of the first extending member 120 is a convex protrusion. The end 127 of the second transmitting unit 123 which exposed from the third pivoting portion 122 of the first extending member 120 is a concave depression. The end 126 of the third transmitting unit 131 which exposed from the second pivoting portion 121 of the second extending member 130 is a convex protrusion. The end 127 of the third transmitting unit 131 which exposed from the third pivoting portion 122 of the second extending member 130 is a concave depression. The foregoing convex protrusion can be a cylinder (shown in FIG. 2) or a hemisphere (shown in FIG. 3), and the foregoing concave depression is corresponding to the convex protrusion. When the first extending member 120 to is pivotally connected to the second extending member 130, the end 126 (such as a convex protrusion) is pivotally connected to the end 127 (such as a concave depression). Therefore, the angle of antenna structure can be varied by the pivoting connection between the first extending member 120 and the second extending member 130.

Figure 4:
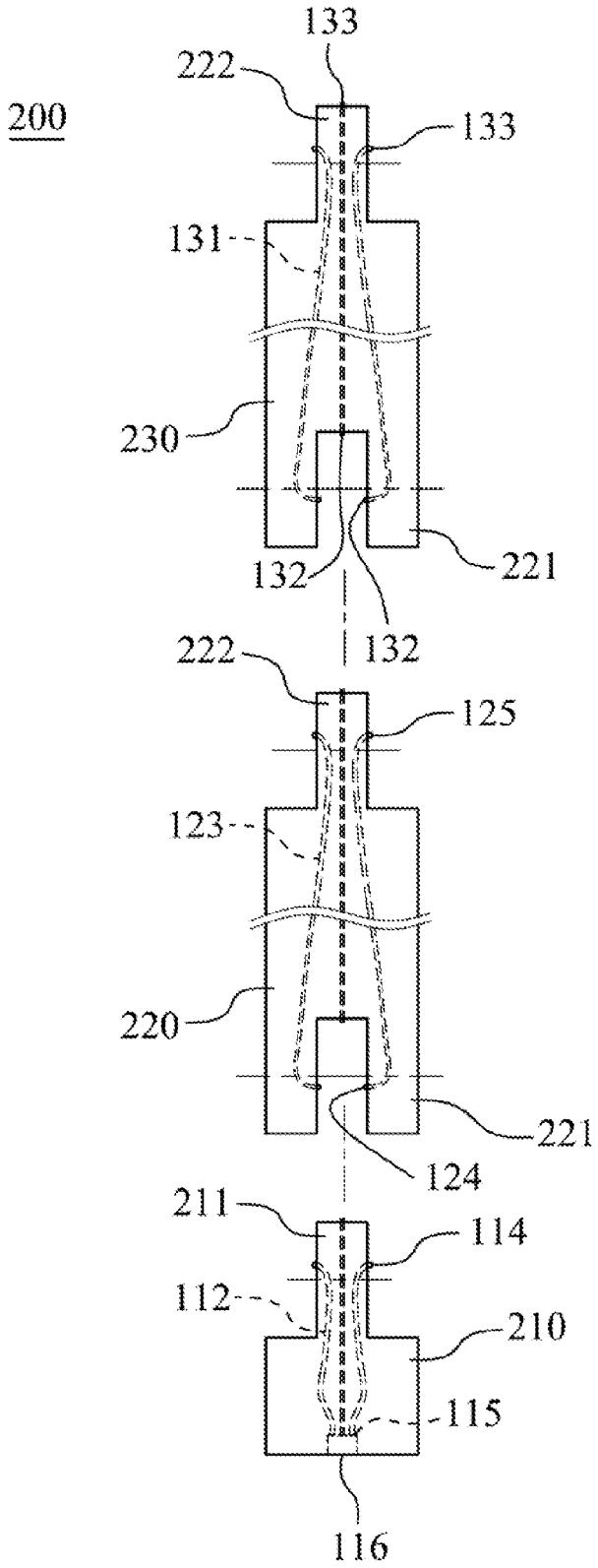
FIG. 4 shows an exploded view of an antenna structure according to yet another embodiment of the present disclosure.

FIG. 4 shows an exploded view of an antenna structure 200 according to yet another embodiment of the present disclosure. The antenna structure 200 includes a plastic base 210, a first plastic extending member 220 and a second plastic extending member 230. The plastic base 210 has a first connecting portion 211 and an outputting end 116 and includes a first transmitting unit 112. The first transmitting unit 112 is located in the plastic base 210, wherein two ends 114, 115 of the first transmitting unit 112 are electrically connected to the outputting end 116 and the first connecting portion 211 of the plastic base 210 respectively, and the end 114 which connected to the first connecting portion 211 is exposed from the first connecting portion 211. The first plastic extending member 220 has a second connecting portion 221 and a third connecting portion 222, wherein the second connecting portion 221 of the first plastic extending member 220 is detachably connected to the first connecting portion 211 of the plastic base 210. The first plastic extending member 220 includes a second transmitting unit 123, wherein the second transmitting unit 123 is located in the first plastic extending member 220, and two ends 124, 125 of the second transmitting unit 123 are electrically connected to and exposed from the second connecting portion 221 and a third connecting portion 222 of the first plastic extending member 220 respectively. The second plastic extending member 230 has a second connecting portion 221 and a third connecting portion 222, wherein the second connecting portion 221 of the second plastic extending member 230 is detachably connected to the third connecting portion 222 of the first plastic extending member 220. The second plastic extending member 230 includes a third transmitting unit 131 located in the second plastic extending member 230, wherein two ends 132, 133 of the third transmitting unit 131 are electrically connected to and exposed from the second connecting portion 221 and a third connecting portion 222 of the second plastic extending member 230 respectively.

Figure 5:
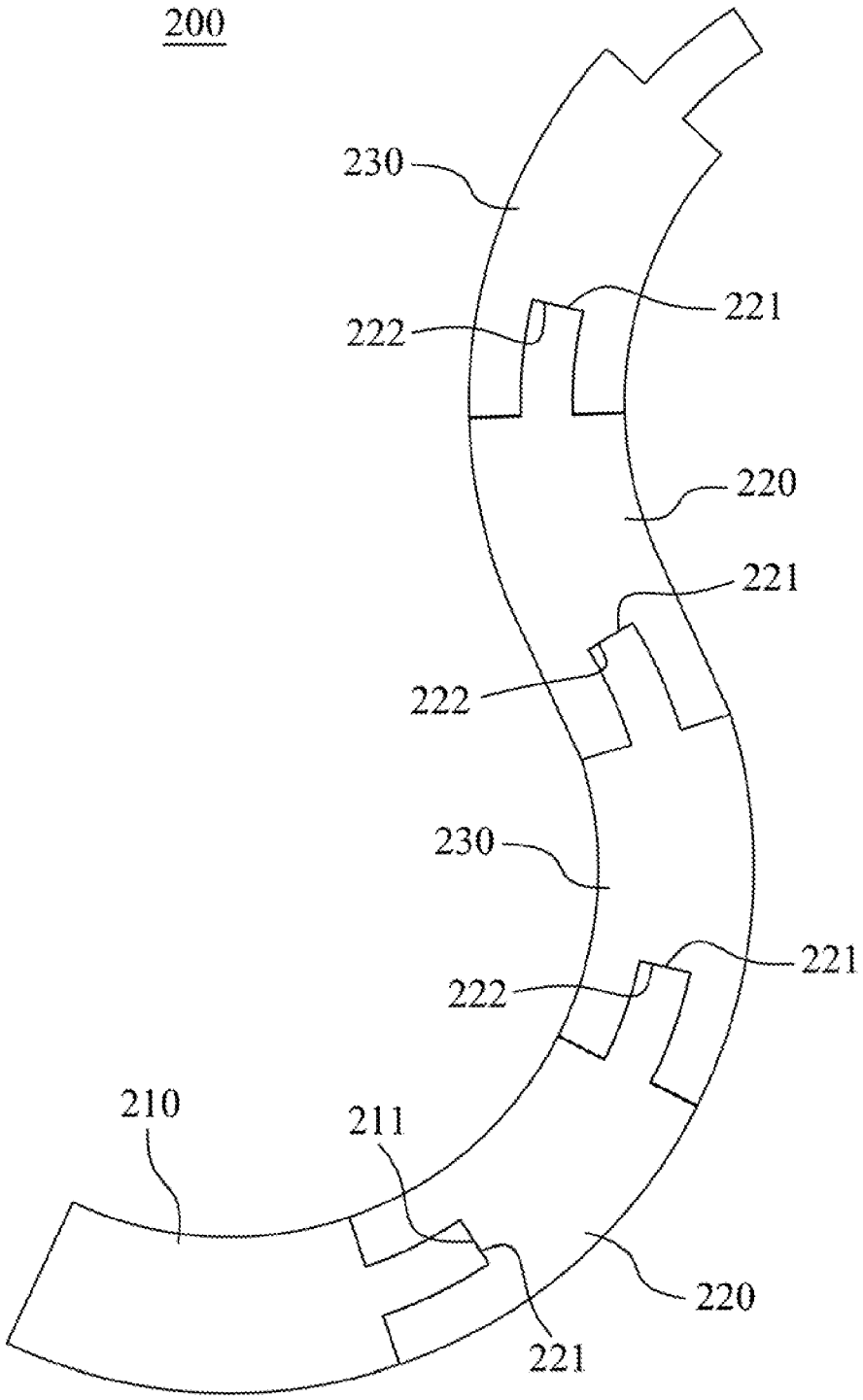
FIG. 5 shows a schematic view of an antenna structure according to further another embodiment of the present disclosure.

FIG. 5 shows a schematic view of an antenna structure 200 according to further another embodiment of the present disclosure. In FIG. 5, the antenna structure 200 includes a plastic base 210, a plurality of first plastic extending members 220 and a plurality of second plastic extending members 230, wherein the first connecting portion 211 of the plastic base 210 is detachably connected to the second connecting portion 221 of one of the first plastic extending members 220 which adjacent to the plastic base 210, the third connecting portions 222 of the first plastic extending members 220 are detachably connected to the second connecting portions 221 of the second plastic extending member 230, and the third connecting portion 222 of one of the second plastic extending members 230 which between the first plastic extending members 220 is detachably connected to the first connecting portion of one of the first plastic extending members 220. When the plastic base 210, the first plastic extending members 220 and the second plastic extending members 230 are assembled, the first transmitting unit 112, the second transmitting unit 123 and the third transmitting unit 131 can be electrically connected together. When the third transmitting unit 131 in the second plastic to extending members 230 receives the external signal, the external signal can be transmitted from the third transmitting unit 131 through the second transmitting unit 123 to the first transmitting unit 112, and then, the external signal can be outputted through the outputting end 116 for signal processing. In detail, the plastic base 210, the first plastic extending members 220 and the second plastic extending members 230 can be made of plastic polymeric material. Therefore, the antenna structure 200 is flexible for changing the angle thereof. Also, the antenna structure 200 can be assembled with more first plastic extending members 220 and more second plastic extending members 230 on demand.

Figure 6:
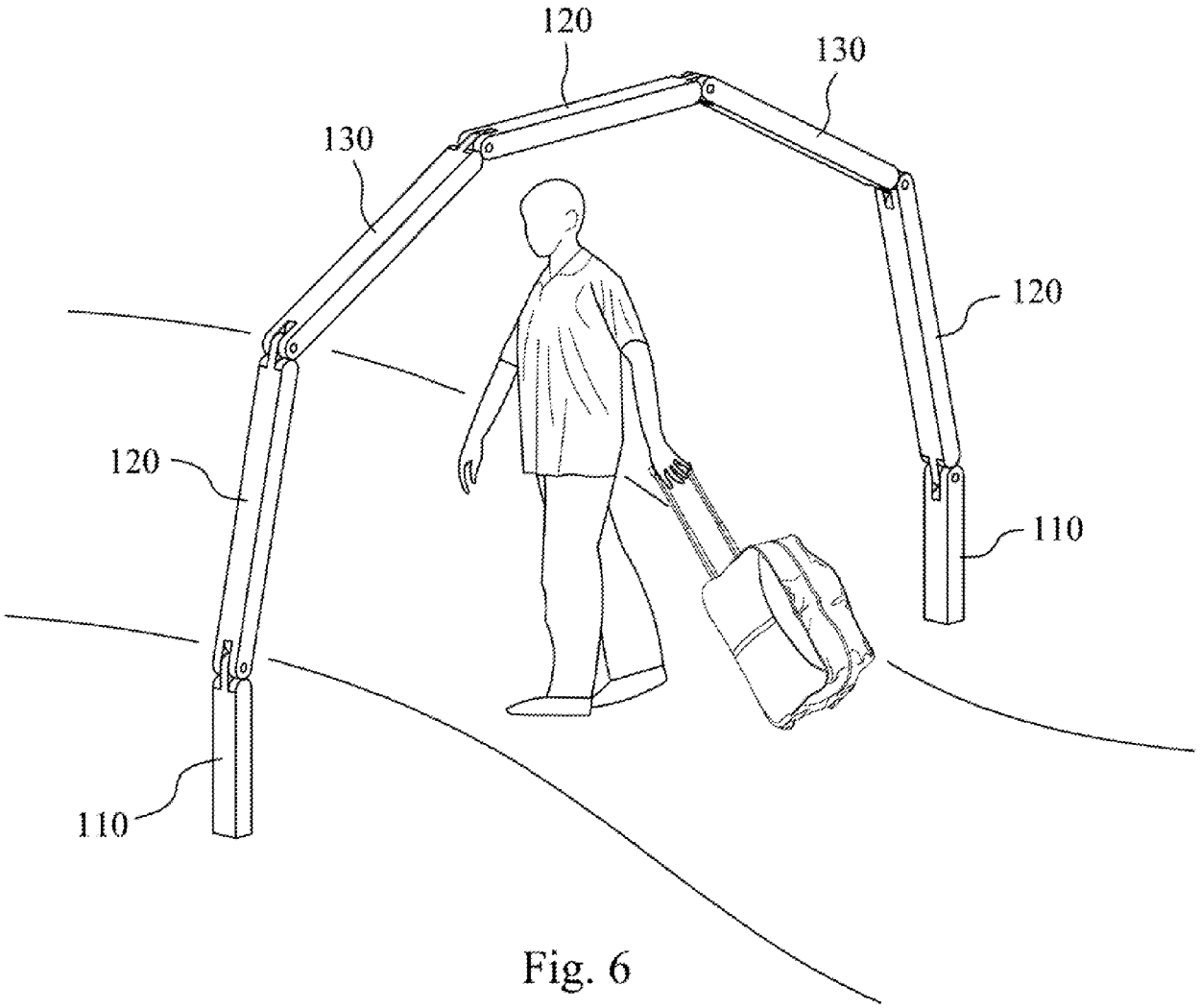
FIG. 6 shows a schematic view of a usage state of an antenna structure according to still another embodiment of the present disclosure.

FIG. 6 shows a schematic view of a usage state of an antenna structure according to still another embodiment of the present disclosure. The plastic base 110, the first plastic extending members 120 and the second plastic extending members 130 of the antenna structure are assembled into an arch-shaped sensor, so that the antenna structure can be used in the airport for checking the luggage or the container. Moreover, when the antenna structure would be moved, the antenna structure can be easily folded and carried.

Figure 7:
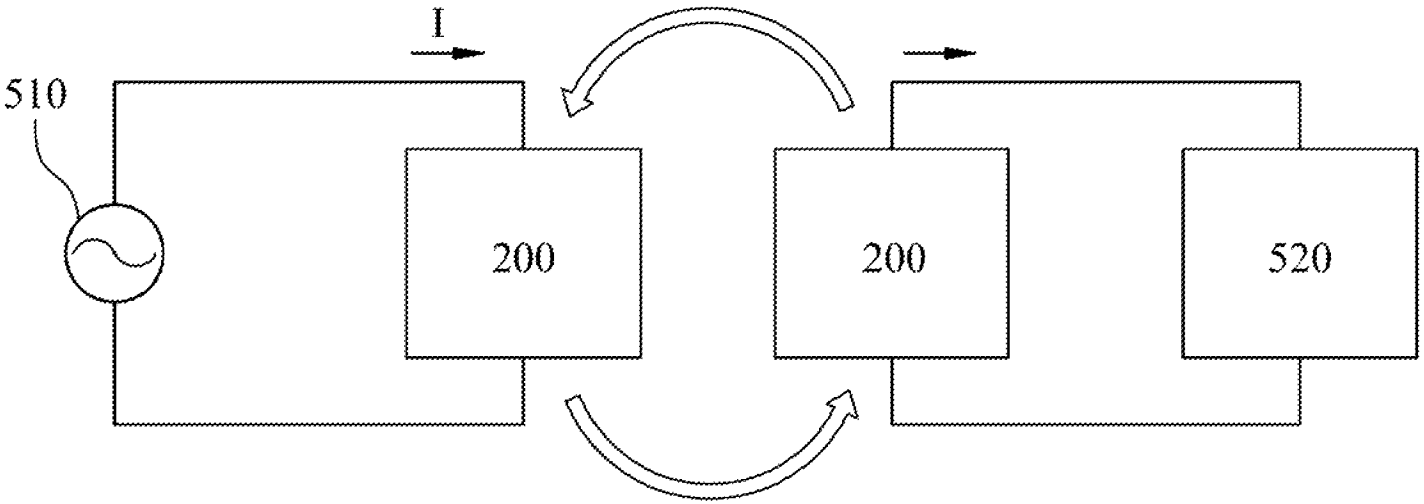
FIG. 7 shows a schematic view of an induction charging system with an antenna structure according to still another embodiment of the present disclosure.

FIG. 7 shows a schematic view of an induction charging system with an antenna structure according to yet another embodiment of the present disclosure. The induction charging system includes two antenna structures 200, a power source 510 and a charging device 520, wherein one of the power source 510s is connected to the power source 510, and the other power source 510 is connected to the charging device 520. When the electric current applied from the power source 510 passes through the antenna structure 200 connected to the power source 510, the induction current of the other antenna structure 200 can be provided, and the charging device 520 can be charged. When the size and the shape of the antenna structures 200 are adjusted, the induction current can be adjusted.

The antenna structure of the present disclosure can be applied to a speed camera. When the vehicle passed through the speed camera, the antenna structure of the speed camera would produce the induction current for monitoring the vehicle. The antenna structure also can be easily detached from the speed camera for improving the convenience and decreasing the cost.

According to the foregoing embodiments, the antenna structure of the present disclosure has the advantages as follow.

1. In general, lengths of RFID devices or NFC devices are fixed. However, the antenna structure of the present disclosure is assembled by a plurality of extending members. Therefore, the application of the antenna structure can be more convenience.

2. The length, size and shape of the antenna structure of the present disclosure can be adjusted easily for applying to the specific wireless device and environment, and the pivoting angle of the element of the antenna structure can be varied easily. Therefore, the application of the antenna structure would be wider.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna structure, comprising:

a base having a first pivoting portion and an outputting end, the base comprising:

a first transmitting unit located in the base, wherein two ends of the first transmitting unit are electrically connected to the outputting end and the first pivoting portion of the base respectively, and the end which connected to the first pivoting portion is exposed from the first pivoting portion;

a first extending member having a second pivoting portion and a third pivoting portion, wherein the second pivoting portion of the first extending member is detachably and pivotally connected to the first pivoting portion of the base, and the first extending member comprises:

a second transmitting unit located in the first extending member, wherein two ends of the second transmitting unit are electrically connected to and exposed from the second pivoting portion and the third pivoting portion of the first extending member respectively; and a second extending member having a second pivoting portion and a third pivoting portion, wherein the second pivoting portion of the second extending member is detachably and pivotally connected to the third pivoting portion of the first extending member, and the second extending member comprises:

a third transmitting unit located in the second extending member, wherein two ends of the third transmitting unit are electrically connected to and exposed from the second pivoting portion and the third pivoting portion of the second extending member respectively;

wherein the first pivoting portion of the base and the third pivoting portions of the first extending member and the second extending member are convex-shaped, and the second pivoting portions of the first extending member and the second extending member are convex-shaped;

wherein the end of the first transmitting unit which exposed from the first pivoting portion is a concave depression, the end of the second transmitting unit which exposed from the second pivoting portion is a convex protrusion, the end of the second transmitting unit which exposed from the third pivoting portion is a concave depression, the end of the third transmitting unit which exposed from the second pivoting portion is a convex protrusion, and the end of the third transmitting unit which exposed from the third pivoting portion is a concave depression.

2. The antenna structure of claim 1, wherein the ends of the second transmitting unit and the third transmitting unit are exposed from virtual axes of the second pivoting portion and the third pivoting portion of the first extending member and the second extending member.

3. The antenna structure of claim 1, further comprising:

a wireless transmitter detachably and pivotally connected to the outputting end of the base.

4. The antenna structure of claim 1, wherein the base further comprises a controlling unit.

5. The antenna structure of claim 1, wherein the first transmitting unit, the second transmitting unit and the third transmitting unit are made of conducting material.

6. The antenna structure, of claim 5, wherein the first transmitting unit, the second transmitting unit and the third transmitting unit are made of copper wire.

7. The antenna structure of claim 5, wherein the first transmitting unit, the second transmitting unit and the third transmitting unit are made of aluminium wire.

8. The antenna structure of claim 1, wherein the first extending member and the second extending member are geometric-shaped.

9. An antenna structure, comprising:

a flexible plastic base made of plastic polymeric material and having a first connecting portion and an outputting end, the plastic base comprising;

a first transmitting unit located in the flexible plastic base, wherein two ends of the first transmitting unit are electrically connected to the outputting end and the first connecting portion of the flexible plastic base respectively, and the end which connected to the first connecting portion is exposed from the first connecting portion;

a first flexible plastic extending member made of plastic polymeric material and having a second connecting portion and a third connecting portion, wherein the second connecting portion of the first flexible plastic extending member is detachably connected to the first connecting portion of the flexible plastic base, and the first flexible plastic extending member comprises:

a second transmitting unit located in the first flexible plastic extending member, wherein two ends of he second transmitting unit are electrically connected to and exposed from the second connecting portion and a third connecting portion of the first flexible plastic extending member respectively; and a second flexible plastic extending member made of plastic polymeric material and having a second connecting portion and a third connecting portion, wherein the second connecting portion of the second flexible plastic extending member is detachably connected to the third connecting portion of the first flexible plastic extending member, and the second flexible plastic extending member comprises:

a third transmitting unit located in the second flexible plastic extending member, wherein two ends of the third transmitting unit are electrically connected to and exposed from the second connecting portion and a third connecting portion of the second flexible plastic extending member respectively;

wherein the first pivoting portion of the flexible plastic base and the third pivoting portions of the first flexible plastic extending member and the second flexible plastic extending member are convex-shaped, and the second pivoting portions of the first flexible plastic extending member and the second flexible plastic extending member are convex-shaped;

wherein the end of the first transmitting unit which exposed from the first pivoting portion is a concave depression, the end of the second transmitting unit which exposed from the second pivoting portion is a convex protrusion, the end of the second transmitting unit which exposed from the third pivoting portion is a concave depression, the end of the third transmitting unit which exposed from the second pivoting portion is a convex protrusion, and the end of the third transmitting unit which exposed from the third pivoting portion is a concave depression.

* * * * *